United States Patent [19]

Popovitch

[11] 4,230,042

[45] Oct. 28, 1980

[54] POINT-DETONATING IMPACT FUZE

[76] Inventor: Dragolyoub Popovitch, 37 Myers Ave., Denville, N.J. 07834

[21] Appl. No.: 927,126

[22] Filed: Jul. 26, 1978

[51] Int. Cl.[3] ..... F42C 9/00; F42C 9/14

[52] U.S. Cl. ..... 102/233; 102/270; 102/271

[58] Field of Search ..... 102/230–233, 102/235, 238, 248, 249, 270, 271

[56] References Cited

U.S. PATENT DOCUMENTS

| | | | |
|---|---|---|---|
| 1,933,608 | 11/1933 | Teitscheid | 102/271 |
| 2,129,692 | 9/1938 | Hottinger | 102/271 X |
| 2,541,082 | 2/1951 | McCoslin | 102/233 |
| 2,664,822 | 1/1954 | Hale | 102/231 |
| 3,115,094 | 12/1963 | Simmen | 102/270 X |
| 3,345,947 | 10/1967 | Combourieux | 102/270 X |
| 3,465,676 | 9/1969 | Simmen | 102/233 |
| 3,547,034 | 12/1970 | Popovitch et al. | 102/232 |
| 3,788,229 | 1/1974 | Simmen et al. | 102/271 X |
| 3,788,230 | 1/1974 | Losfeld | 102/270 X |
| 3,977,329 | 8/1976 | Wilde | 102/270 |

*Primary Examiner*—David H. Brown

[57] ABSTRACT

This is a new point-detonating fuze for spin-stabilized munitions. The fuze has three modules housed in a two-piece body, designed to optimize the penetration capability and to adjust the weight of the fuze. The upper body carries the point-detonating module which has a double-initiation feature, designed to function on impact against the target but preventing detonation on impact against rain droplets and against the foliage of wooded areas. The explosion, initiated at the top of the point-detonating module, is propagated by a mild-detonating fuze, first axially inside the shaft of the point-detonating module, then axially through the time-delay module, to reach the detonator in the safing-and-arming module. The point-detonating module acts as a selector designed to provide either a super-quick function or a time-delay function with several time-delay options. The desired choice is made by rotating the moving portion of the time-delay module to one of several pre-indexed positions.

13 Claims, 8 Drawing Figures

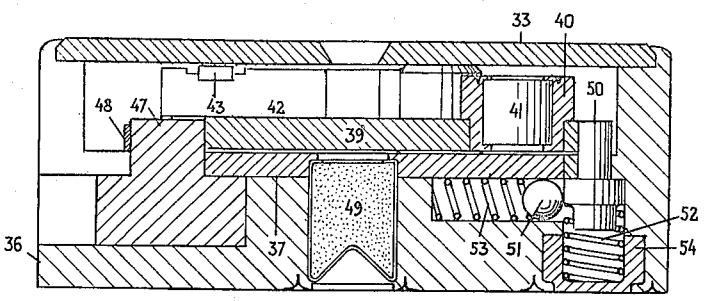
FIG. 6:
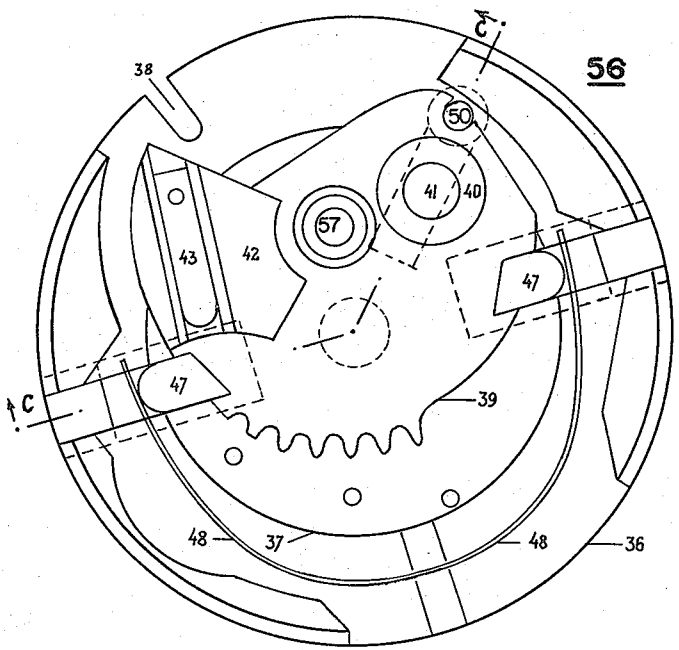
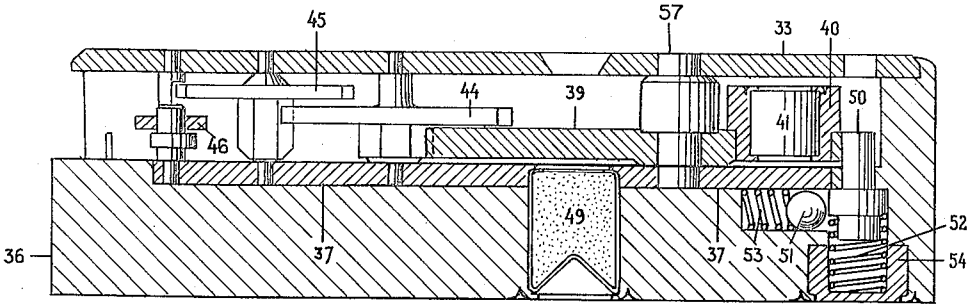
FIG. 8:
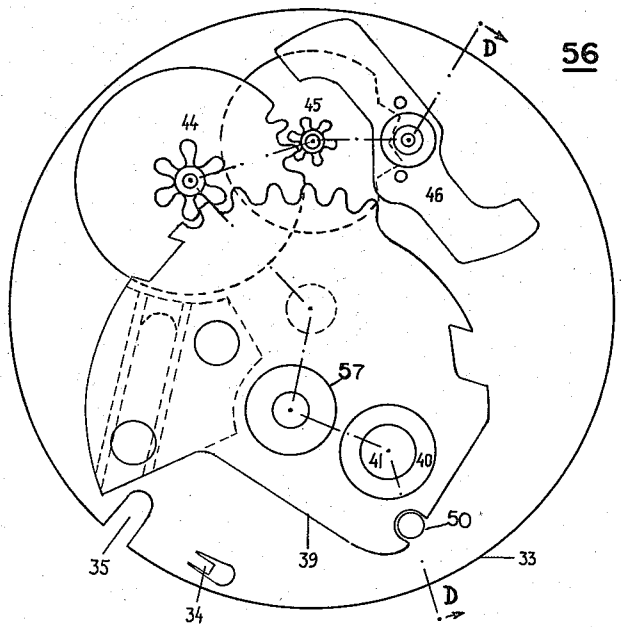

POINT-DETONATING IMPACT FUZE

SUMMARY OF THE INVENTION

The present invention relates to a completely new point-detonating fuze for spin-stabilized artillery munition, designed to be used in all existing and future tube-artillery weapons of medium and large caliber.

The invention was conceived to achieve several objects, as follows:

1. To provide a fuze with maximum flexibility for optimizing the penetration capacity and for adjusting the weight of the fuze, by using a two-piece body so that each part could be made of materials best suited to satisfy variable requirements without changing the shape and dimensions of constituent parts.

2. To increase the reliability of the fuze in the super-quick mode of function, by using a mild-detonating fuze (MDF) to insure a double initiation at the tip of the point-detonating module and to propagate the explosion directly to the detonator in the safing-and-arming (S&A) module, instead of jumping a gap of up to three inches as in the existing PD fuzes.

3. To increase the reliability, the timing accuracy and the number of options in the time-delay mode of function, by using a small-delay column (SDC) in combination with several primers and one output detonator, whose explosion is received and further propagated by the same MDF used to transfer the explosion from the point-detonating module to the detonator in the S&A module.

4. To provide a fuze with a simple mechanism for selecting the desired mode of function, by using the point-detonating module, with its axially-located MDF-carrying shaft as a rotating selector which causes the moving portion of the time-delay module to bring the appropriate primer into firing position.

5. To improve the safety, the reliability and the universality of the S&A module, by using: a novel, high-setback, returnable, setback-pin arrangement; an anti-mal-assembly feature; a novel spin-detents design; all in an envelope packaging the whole module in a volume which meets the requirements for a universal S&A.

BRIEF DESCRIPTION OF THE DRAWINGS

FIG. 5 is a top view of the S&A module with the top plate and the gear train removed, showing the module in safe position.

FIG. 6 is a longitudinal-section view of the S&A module along the contour C—C indicated in FIG. 5.

FIG. 7 is a bottom view of the S&A module with the bottom plate and the insert plate removed, showing the module in safe position.

FIG. 8 is a longitudinal-section view of the S&A module along the contour D—D indicated in FIG. 7.

DETAILED DESCRIPTION OF A PREFERRED EMBODIMENT

Figure 1:
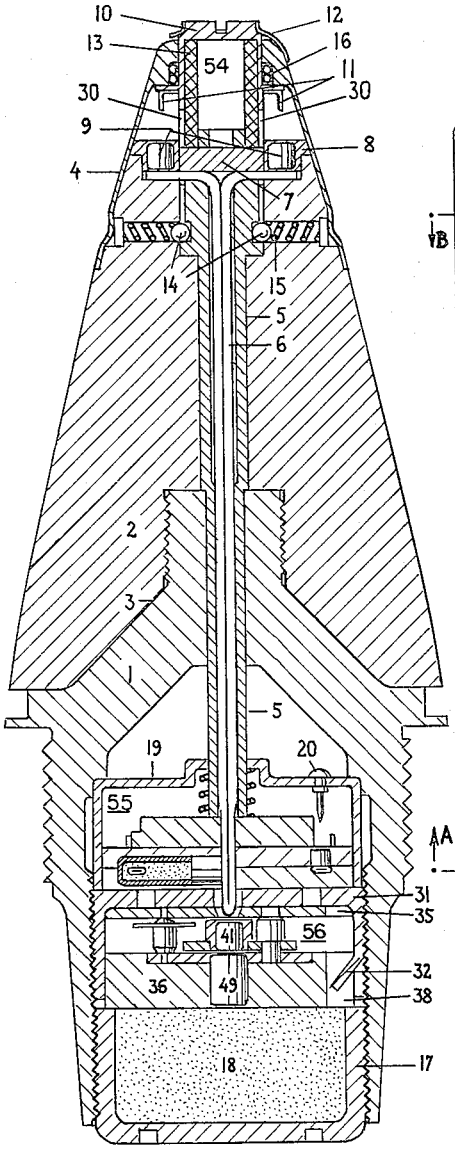
FIG. 1 is a longitudinal-section view of the fuze incorporating the present invention, with the point-detonating module in position for the SQ mode of function, the time-delay module in safe position and the S&A module in armed position.

FIG. 1 is a longitudinal cross-section view of the fuze incorporating the present invention. The upper body 2 is threaded onto the lower body 1 and glued at their interface 3.

The upper body 2 and the cap 4 form a cavity, within which is located the point-detonating module comprising the following parts:

- a shaft 5, carrying two strands of mild-detonating fuze (MDF) 6, and a setting plate 7, pressed into a slot in the shaft 5;
- a detonator holder 8, carrying two detonators 9;
- a setting key 10, carrying a firing plate with two firing pins 11 and an indicator 12, and housing a crush-element 13;
- two orientation balls 14, with their springs 15; and, finally.
- two O-rings 16, to seal off the cavity.

Figure 2:
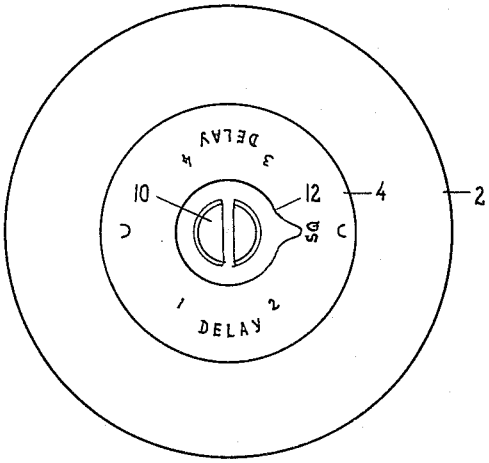
FIG. 2 is a top view of the fuze as stockpiled, with the indicator showing the fuze set for the SQ mode of function.

As shown in FIG. 2, the cap 4 has marks indicating five setting options: one for the SQ mode and four positions for the time-delay function.

The upper body 2 is made of a material best suited to satisfy the fuze requirements. For example, it could be made of a plastic material, so that appropriate fillers could be used to satisfy the weight requirements for a complete fuze while keeping unaltered the shape and the dimensions of constituent parts.

The lower body 1 is made of a metal which best satisfies the penetration requirements at a minimum possible cost.

Instead of two pieces, the body could consist of one piece, if a material is available which could satisfy both weight and penetration requirements at a smaller production cost.

The lower body 1 is essentially a hollow cup, open at the bottom end while closed with a conical shape at the top end. The outside shape of the body and the shape of the cavity can be adjusted to achieve maximum penetration capability with a given quantity of metal.

Inside the lower body 1 are mounted: a time-delay module 55, a safing-and-arming module (S&A) 56, and a booster comprising a booster cup 17 and a pellet 18.

Figure 4:
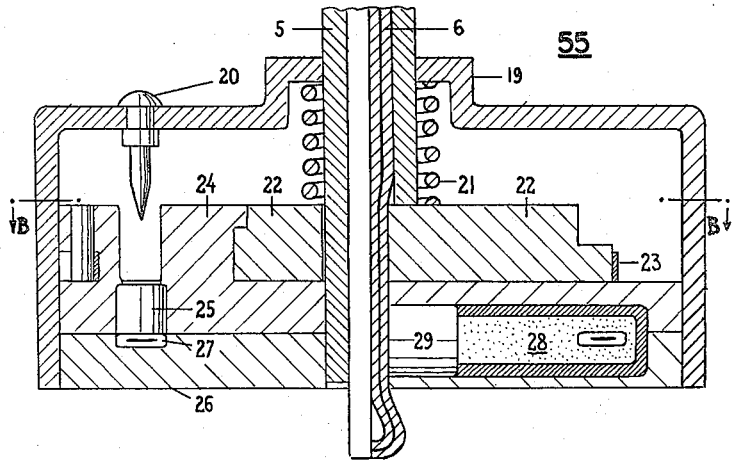
FIG. 4 is a longitudinal-section view of the time-delay module, along the contour A—A indicated in FIG. 3, showing the module in the same position as FIG. 3.
Figure 3:
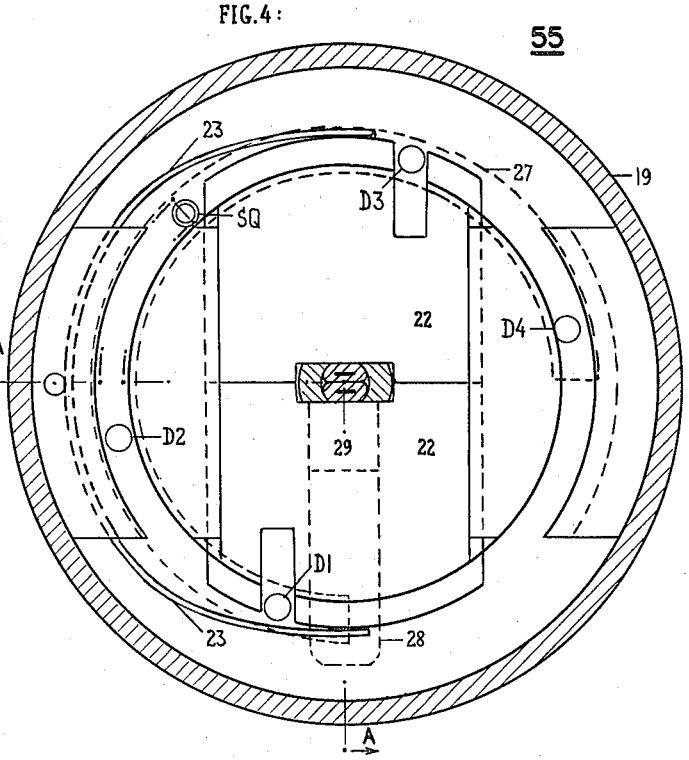
FIG. 3 is a transversal-section view of the time-delay module, at the level B—B just above the module's moving portion, showing the module in safe position set for the SQ mode of function.

The time-delay module is shown at a bigger scale and with more details in FIG. 3 and FIG. 4. It comprises the following parts:

- a housing 19, carrying a firing pin 20;
- a creep spring 21;
- two spin detents 22, with one leaf spring 23;
- an upper plate 24, carrying five primers 25 (D1, D2, SQ, D3, D4), and a lower plate 26, carrying a circular small-delay column 27 (SDC), a transfer charge 28 and an output detonator 29.

The small-delay column is a continuous core of pyrotechnic delay material encased in a seamless metal sheath, which is placed within a circular groove in the plate 26.

The housing 19, with the firing pin 20, is pressed into the lower body 1 and does not move, while all other parts, except the creep spring 21, are assembled into one entity forming the moving portion of the time-delay module.

Both the upper plate 24 and the lower plate 26 have in the center a hole, through which passes the lower end of the shaft 5, and their shape is such that the moving portion of the time-delay module must rotate together with the shaft 5. The upper end of the shaft 5 has six shallow holes at 60° intervals. Into those holes can engage two orientation balls 14, designed to hold the shaft 5—and, through it, the moving portion of the time-delay module—in one of five possible positions, in which one of the five primers 25 is aligned with the firing pin 20. The setting is accomplished by turning the setting key 10, which has two diametrically opposed slots 30 engaging the setting plate 7, through which the rotation of the setting key 10 is transmitted to the shaft 5 and, through it, to the moving portion of the time-delay module. The indicator 12, carried by the setting key 10, shows which position has been selected, as can be seen in FIG. 2.

The time-delay module is supported and held in place by the cup 31, threaded tight inside the lower body 1 against the housing 19. One small segment of the cylindrical portion of the cup 31 is cut out and bent inside to form the finger 32, whose role will be described later in connection with the S&A module.

The safing-and-arming module (S&A) is shown in detail in FIGS. 5, 6, 7 and 8. It comprises the following parts:

- an upper plate 33, exhibiting a finger 34 and a slot 35;
- a lower plate 36, with an insert plate 37 and a slot 38;
- a rotor 39, carrying a detonator holder 40 with a detonator 41 and a weight 42 with a locking spring 43;
- a standard gear train, consisting of two gear-and-pinion subassemblies 44 and 45, and a lever 46;
- two spin detents 47, with their leaf spring 48;
- an explosive lead 49; and, finally,
- a setback-pin arrangement consisting of a setback pin 50, a ball 51, two springs 52 and 53, and a closing cup 54.

When the S&A module is mounted on the fuze, it must be oriented so that the finger 32 can pass through the slot 35 in the upper plate 33 and into the slot 38 in the lower plate 36, thus making sure that the rotor 39 is in safe position. The finger 32 and the slots 35 and 38 constitute the anti-mal-assembly feature of the S&A.

When manufactured and delivered for a stockpile, the fuze is set for SQ, because that corresponds to the most often-used mode of function. The resulting configuration is as follows:

- in the point-detonating module, the two firing pins 11, the two detonators 9 and the two upper ends of the MDF 6 are aligned in the same plane as shown in FIG. 1;
- in the time-delay module, the SQ primer 25 is aligned with the firing pin 20, the creep spring 21 is compressed, and the two spin detents 22 are in the safe position, interlocked with the shaft 5 as shown in FIG. 3 and FIG. 4;
- in the S&A module, the rotor 39 is in safe position, held by two spin detents 47 and the setback pin 50, in compliance with the double-safety requirement.

The arrangements of the spin detents and of the setback pin are conceived to maximize the safety of the munition during the handling, transportation and firing.

The spin detents are diametrically opposed, and stay so if and when they move, so that a shock could never push both detents out of engagement.

The setback-pin arrangement makes it possible to design for as high a setback as desired to maximize the handling safety. In case of shock, the setback pin always returns to safe position, because the spring 52 is designed to reliably overcome the opposing force of the spring 53 and to push the ball 51 out of its way. Hence, that safety feature always stays effective until the moment of firing. However, when the fuze is fired, the following sequence takes place: first, the setback pushes the setback pin 50 against the spring 52, while the spring 53 and the spin push the ball 51 against the smaller diameter of the pin 50; but then, upon setback decay, in addition to the force of the spring 53, the ball 51 continues to be pushed by the centrifugal force due to the spin, so that the spring 52 can no longer overcome the opposition of these two forces; the setback pin 50, therefore, does not return, and the rotor 39 is free to arm. In order to maximize the relative value of the centrifugal force acting on the ball 51, the setback pin 50 should be made of a light material and the ball 51 of a heavy material.

When the spin reaches the required value, the spin detents 47 in the S&A and 22 in the time-delay module are pushed out by the centrifugal force against their respective springs 48 and 23, until they hit the walls of the housings. Then the rotor 39, driven by the centrifugal force acting through unbalanced weight, rotates with its eccentrically located shaft 57 while the lever 46 controls the movement acting as a runaway escapement and, when the arming time has elapsed, it snaps into armed position, while the locking spring 43 goes over the hump of the finger 34 and locks the rotor 39 in armed position. Meanwhile, in the time-delay module, when the spin detents 22 reach their out-positions, the creep spring 21 extends until it reaches the upper plate 24 and locks the spin detents 22 in their out-positions; thus, at impact against the target, the spin detents 22 cannot come back to stop the moving portion of the time-delay module from sliding forward and causing one of the primers 25 to hit the firing pin 20.

If the fuze is set for the SQ function, the impact against the target causes the setting key 10 to crush the crush-element 13 and the pins 11 to hit the detonators 9, initiating the explosion which is received and further propagated by the MDF 6 to the input face of the detonator 41, whose explosion is amplified by the lead 49 and the pellet 18, resulting finally in the explosion of the main charge of the projectile.

If the fuze is set for the delay function, the pins 11 and the receiving ends of the MDF 6 are out of line with the detonators 9, so that the crushing of the point-detonating module can no longer cause a SQ function. In that case, the moving portion of the time-delay module—well protected inside the lower body 1 and with the spin detents 22 locked by the creep spring 21—slides forward under influence of inertia until the selected primer 25 hits the firing pin 20. The output of the primer 25 initiates a burning inside the SDC 27, eventually setting off the chain explosion of the transfer charge 28 and the detonator 29, from where the explosion is received by the MDF 6 and propagated, through the same sequence as before, to the main charge of the projectile.

There are four options for the time-delay function. The shortest is D1 and the longest is D4, as shown in FIG. 3. The primer 25 marked by letters SQ on FIG. 3 is a back-up for SQ function, to cause the projectile to explode even if—because of a soft target or a glancing impact, or for some other reason—the point-detonating module fails to function.

I claim:

1. A point-detonating impact fuze for spin-stabilized projectiles, having a two-piece body and comprising:

a point-detonating module housed in the upper portion of said two-piece body including an axially located shaft;

a time-delay module housed in the lower portion of said two-piece body having means for setting a preselected mode of function;

a safing and arming module housed in the lower portion of said two-piece body below said time-delay module;

said axially located shaft communicating said point-detonating module with said time-delay module and said safing and arming module;

an explosive train located in said modules and inside said shaft;

a means in said point-detonating module to engage said axially located shaft communicating with said time-delay module to set the fuze for a preselected mode of function.

2. A fuze as in claim 1, wherein the upper portion of said two-piece body is made out of light soft material and the lower portion of said two-piece body is made out of hard heavy material, with the two portions attached to each other to form a solid body.

3. A fuze as in claim 1, wherein the time-delay module positioned in a housing and having an upper and a lower plate includes:

a fixed firing pin attached to said housing;

spin detents carried by said upper plate;

primers attached to said upper plate;

a helical spring positioned between said housing and said spin detents;

a time-delay column carried by said lower plate;

an output detonator positioned on said lower plate;

a transition charge located between said time-delay column and said output detonator.

4. A fuze as in claim 3 said, wherein explosive train includes:

two detonators located in said fixed ring in said point-detonating module;

two strands of mild detonating fuze inside said axially located shaft;

a time-delay column carried by said lower plate of said time-delay module;

an output detonator positioned on said lower plate of said time-delay module;

a transition charge located between said time-delay column and said output detonator;

a detonator carried by said safing and arming module;

a lead located in said lower plate of said safing and arming module;

a booster charge in a cup threaded into lower portion of said two-piece body below said safing and arming module.

5. A fuze as in claim 1, wherein the means in said point-detonating module includes:

a setting key;

said point-detonating module further including a crush element located inside said setting key;

a firing plate having two firing pins and carried by said setting key;

a fixed ring carrying two detonators;

a means of locking said axially located shaft in preselected position.

6. The combination of claim 5, wherein said setting key has two longitudinal slots engaging said axially located shaft.

7. A fuze as in claim 5, wherein said; axially located shaft includes:

a setting plate engaged in said two longitudinal slots of said setting key;

a slot at the upper end in which said setting plate is pressed;

holes or flat surfaces at the upper end to hold said axially located shaft in a preselected position;

two flat surfaces at the lower end engaging said time-delay module to rotate said time-delay module into a preselected position and guide said time-delay module in its forward motion at impact.

8. A fuze as in claim 1, wherein said time-delay module is supported by a cup threaded into lower portion of said two-piece body and said cup having a finger cut out of its cylindrical wall.

9. A fuze as in claim 1, wherein safing and arming module includes:

an upper and a lower plate;

timing means between said upper and lower plates;

a setback pin arrangement engaging said timing means;

two spin detents engaging said timing means.

10. The combination of claims 8, or 9, wherein said upper and lower plate each have a slot allowing passage of said finger.

11. The combination of claim 9, wherein timing means includes:

a rotor carrying a detonator and engaging a gear train;

a runaway escapement controlling the movement of said rotor through said gear train.

12. The combination of claim 9, wherein setback pin arrangement includes:

a helical spring located eccentrically in said lower plate and parallel to the fuze axis;

a ball with its helical spring located radially in said lower plate and pressing against said setback pin arrangement.

13. The combination of claim 9, wherein two spin detents are located in said lower plate in diametrically opposed cavities sliding radially against the two ends of a leaf spring.

* * * * *